United States Patent [19]

Lala

[11] 4,254,706

[45] Mar. 10, 1981

[54] ACCESSORY FOR PRINTING OVAL OBJECTS

[75] Inventor: Louis A. Lala, Skokie, Ill.

[73] Assignee: American Screen Printing Equipment Company, Chicago, Ill.

[21] Appl. No.: 22,937

[22] Filed: Mar. 22, 1979

[51] Int. Cl.[3] ..... B41F 17/00; B41F 17/28

[52] U.S. Cl. ..... 101/38 R; 101/126

[58] Field of Search ..... 101/38 R, 38 A, 39, 101/40, 126, 123, 124

[56] References Cited

U.S. PATENT DOCUMENTS

| | | | |
|---|---|---|---|
| 3,810,422 | 5/1974 | Kammann | 101/126 X |
| 4,068,579 | 1/1978 | Poo et al. | 101/38 R |
| 4,111,118 | 9/1978 | Green et al. | 101/38 R X |

FOREIGN PATENT DOCUMENTS

| | | | |
|---|---|---|---|
| 2453064 | 5/1975 | Fed. Rep. of Germany | 101/38 A |
| 2714652 | 10/1977 | Fed. Rep. of Germany | 101/38 A |

*Primary Examiner*—Clifford D. Crowder

*Attorney, Agent, or Firm*—Robert E. Wagner

[57] ABSTRACT

A holder accessory is described for use with screen printing presses for adapting the screen printing on three-dimensional objects of revolution of different sizes, all at high speeds. The holder accessory is capable of being loaded manually or automatically and comprises a nesting assembly which is rocked to present the peripheral surface of the object to be printed to the screen at precisely the same linear speed as the screen. A drive tee mounted on the drive carriage captivates an extension of an upper end of a drive slide, thereby oscillating the drive slide by its reciprocatory motion. The drive slide is vertically adjustably mounted to the nesting assembly so that its oscillation may be conveyed to the nesting assembly for duplication of the precise linear speed desired on the surface of the object to be printed.

7 Claims, 6 Drawing Figures

ACCESSORY FOR PRINTING OVAL OBJECTS

BACKGROUND OF THE INVENTION

This invention relates to an automatic printing apparatus and, more particularly, to an apparatus for adapting a screen printing machine for the printing of cylindrical or tapered objects.

Screen printing is widely used for printing objects of revolutions such as bottles, cans, cones, and the like. Various types of screen printers are available to accomplish printing of three-dimensional objects, and many, such as that taught in U.S. Pat. No. 3,090,300 utilize an object holder or nest mounted on a shaft extending outwardly from the printer. The screen can be held stationary and the squeegee moved relative to both the screen and the object holder to force the ink through the screen for printing flat objects, or, the squeegee may be held stationary against the screen, and the screen and object may moved, as when printing objects of circular dimensions. For objects of revolution, e.g. circular items, one of these elements is moved in timed relationship to one another during the printing cycle, e.g., the object to be printed ordinarily being rotated while the screen is moved laterally, so that the screen and peripheral surface of the object move at identical linear speeds.

In the past, the timed relationship of the movement of the screen, object, and squeegee has been accomplished by a direct drive mechanism, utilizing a rack and pinion gear system. Such a mechanism is taught in each of U.S. Pat. Nos. 3,090,300 to Dubuit; 3,139,824 to Derrickson; 4,111,118 to Green et al.; and 4,184,427 to Bubley et al. In general, the drive carriage of prior art printing presses is reciprocated on a stationary shaft by a suitable drive means, such as a Geneva cam arrangement or the like. On one side of the drive carriage is a rack which cooperates with a pinion gear for rotating an output shaft extending underneath the screen and connected at an outer portion to a nesting apparatus for holding the object to be printed. The output shaft is mounted on the frame so that upon lateral movement of the drive carriage the output shaft will rotate, thereby rotating the object to be printed.

With such a printing accessory, as noted in U.S. Pat. No. 3,139,824 to Derrickson, the size of the pinion gear is crucial to obtaining a correct speed of revolution of the object for accurate printing. For example, for each object to be printed which is of a different diameter, a different pinion gear of a size directly relating to the diameter or radius of curvature of the object to be printed must be substituted so that the gear ratio relative to that of the rack provides movement of the screen at the same linear rate as the periphery of the bottle being rotated. The casting and machining of individual gears can be expensive, and, in order for a screen printer to have the capability of screen printing a wide variety of bottle and pail sizes and the like on short notice, an equally large variety of such expensive gears must be on hand. Should a printer wish to screen print on an object of nonstandard dimensions, this would necessitate the custom machining of a new gear for each such application, causing undue delay and time and an unnecessary large expenditure of money.

DESCRIPTION OF THE INVENTION

The present invention relates to an improved accessory for use with screen printing machines for rotating circular objects of widely varying diameter for the screen printing of a circular portion of the object. The entire holder or nesting assembly is pivotable about a horizontal axis, being pivotally secured on front and rear mounting blocks at opposite ends of a tooling post which extends horizontally from the printing assembly. The object to be printed, such as a bleach or antifreeze bottle, is securely nested in a holder by a chuck biased against the bottle opening in a manner well known in the art. A drive tee extends perpendicularly downward from the drive carriage, having an integral central vertical channel. An extension, such as a roller, at the upper end of a drive slide is captivated in the channel in a sliding arrangement for free movement of the drive slide in both a rotational and a vertical mode. At the lower end of the drive slide a rear slide bracket captivates the drive slide in a longitudinal sliding engagement, being positionable at a desired height. The rear slide bracket is fixedly connected by guide rods to an upper portion of a rear shaft mount. The lower portion of the rear shaft mount is fixedly attached to a drive shaft which is supported at its midsection for axial rotation by a shaft support. The shaft support is vertically adjustable on the rear mounting block. Thus, the rear slide bracket may follow the pivotal motion of the rear slide holder, and transfer this motion to rotational movement of the drive shaft. The entire nesting assembly, as noted above, is mounted for horizontal pivotal movement between the mounting brackets on the tooling post and is secured to the front end of the drive shaft for following pivotal motion. The rear slide bracket may be fixed at any desired height on the slide which will correspond to the curvature of the object to be printed, thereby allowing a variable arc radius through which the rear slide bracket will swing on the drive slide. The nesting assembly is kept horizontal by appropriate adjustments. As the drive carriage reciprocates along the shaft on which it is mounted, the drive slide follows the reciprocatory motion, itself reciprocating slightly within the channel of the drive tee, describing an arc at its opposite or lower end with its motion. This swinging movement oscillates the shaft mount, which in turn rotates the drive shaft and rocks the entire nesting assembly. Thus, as the drive carriage reciprocates, the object to be printed is rocked, giving the surface of the object to be printed the identical linear speed as the reciprocating screen for precise printing.

This new and improved screen printing machine accessory provides considerable advantages to the printer, allowing one attachment to accommodate a wide range of spherical, oval and conical objects to be printed, needing but a simple adjustment for any given bottle or the like.

Therefore, an object of the subject invention is an improved universal oval printer, having the capability of positioning three-dimensional objects of a plurality of sizes for printing a design or the like on a surface thereof.

A further object of the subject invention is a universal printer which will accommodate objects of various sizes for printing, being adaptable to each size by a simple manual adjustment.

Yet another object of the subject invention is a device which can be easily adjusted to serve as a holder for all sizes of objects of revolution for printing without requiring tooling and/or a change of gears for each different size.

DESCRIPTION OF THE DRAWINGS

Further objects of the invention, together with additional features contributing thereto and advantages accruing therefrom will be apparent from the following description of one embodiment of the invention when read in conjunction with the accompanying drawings wherein:

Referring now to FIG. 1, there is shown a screen printing machine 10 having one embodiment of the oval printer attachment of the subject invention for use in conjunction with the screen printer 10. While the subject invention may be adapted for use with practically all universal printers, the actual printer shown is of the type described in either of U.S. Pat. No. 4,111,118 and U.S. Pat. No. 4,184,427. As shown, the screen printer 10 includes a frame 15, two upright supports (not shown) on which are mounted horizontal shafts 16 and 20 in parallel, a screen and screen frame 14, and a squeegee assembly 12 mounted on shafts 16 for either vertical or lateral movement in a timed relationship, as determined by the movement of the swiss cam 18 stabilized in its reciprocal horizontal movement by a roller 22 in guide channel 24. Tooling post 91 is centrally secured in cantilever fashion in front of the printer to allow attachments such as the subject invention to be secured to it. Drive carriage 26 mounted on shaft 20 is driven by swiss cam 18 for reciprocal lateral movement. For the purposes of the subject invention, feeding of the object to be printed may be by any method, whether manual, semi-automatic, or automatic. In addition, once the subject invention is adjusted for the appropriate stroke in its motion for printing a certain three-dimensional object, the only limitation on the speed in printing successive objects will be largely dependent on the feeding mechanism and the maximum speed of the printing assembly.

Figure 1:
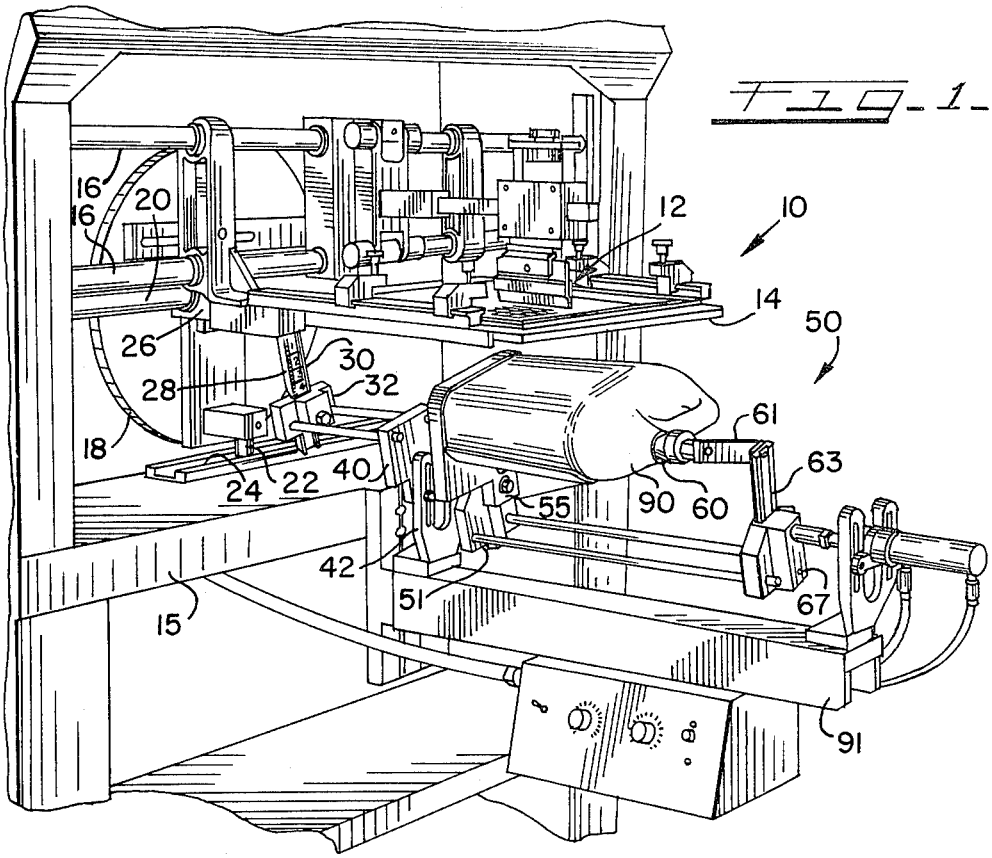
FIG. 1 is a perspective view of the subject invention showing the universal oval printer of the subject invention.
Figure 4:
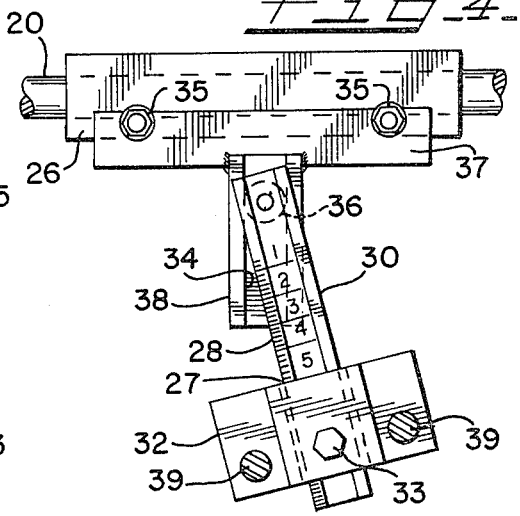
FIG. 4 is a front view of the drive tee assembly taken along the lines 4—4 of FIG. 2 showing the rear slide mounted to the drive tee for following movement.
Figures 2, 5, 6:
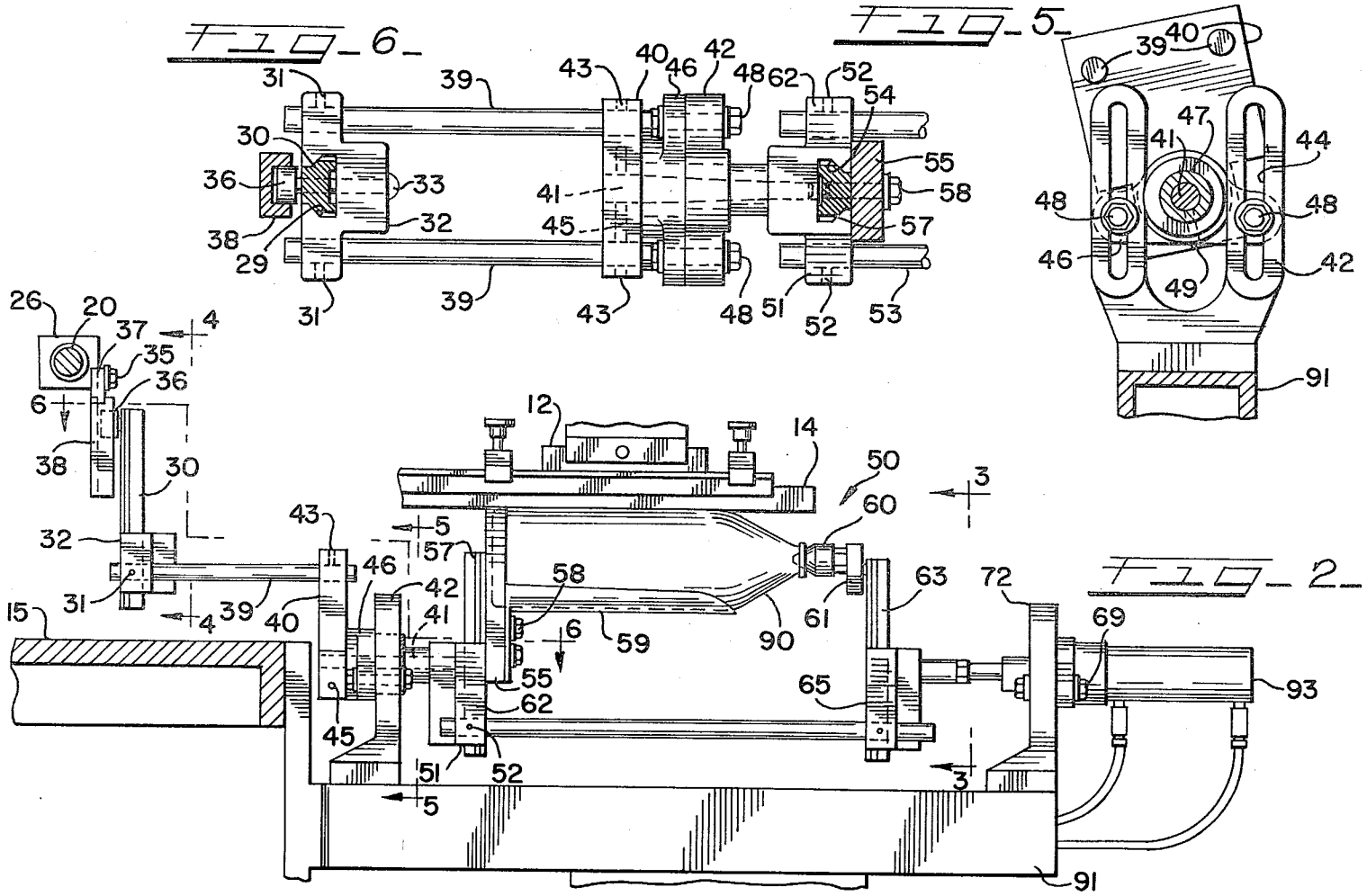
FIG. 2 is a side view of the universal oval printer of the subject invention showing the object to be printed in position for printing.
FIG. 5 is a view taken along the lines 5—5 of FIG. 2 showing the pivotal attachment of the nesting assembly to the drive shaft mount.
FIG. 6 is a top view taken along the lines 6—6 of FIG. 2 showing the double guide and sliding attachment at opposite ends.

Mounted on the drive carriage 26 is a drive tee (FIG. 4), which includes a horizontal bar 37 and slideway, forming a drive tee rigidly secured to the drive carriage 26 in a horizontal manner by bolts 35. The vertical slideway 38 may be affixed perpendicular to the horizontal bar 37 by welding or the like to form the drive tee. Slideway 38 has a longitudinal channel 34 opening outwardly from the screen printing machine 10. The reciprocal lateral movement of the drive carriage 26 and drive tee is translated into a rocking motion which is imputed to the nesting assembly, through a linkage or connection for following motion. In the channel 34 an extension such as roller 36, is captivated for both rotational and vertical movement within channel 34. The roller 36 is attached fixedly at one end of the slideway or arc adjusting bar 30, which in turn is captivated for selective longitudinal movement within channel 29 of rear slide holder 32 (FIG. 6). Within rear slide holder 32 the arc adjusting bar 30 may be secured in a desired fixed vertical position within the opening 29 of rear slide holder 32 by tightening screw 33. Graduations or measurement lines 28 are placed along the length of the arc adjusting bar for reasons which will become apparent (FIGS. 1 and 4).

Two guide rods 39 pass through opposite sides of the rear slide holder 32 and may be secured to provide a desired length by set screws 31. Secured to the opposite ends of each guide rod 39 by set screws 43 is drive block 40 (FIGS. 1, 2, and 6). At a lower end of drive block 40 a drive shaft 41 is fixedly secured to the drive block 40 for following rotation by tightening screw 45, thereby closing gap 49 located at the lower end of drive block 40, and tightly gripping drive shaft 41 (FIG. 5). Drive shaft 41 passes through bushing 47 within the shaft mount 46 for free rotational movement therein. Shaft mount 46 is secured at a desired height within vertical slots 44 by a suitable nut and bolt arrangement 48 (FIG. 5), for coordinating the adjustment of the nesting assembly to a level position at the desired height to correspond with the height selected on the arc adjusting bar for printing an object of a certain size.

The nesting assembly 50 is itself fixedly mounted to and supported by the drive shaft 41 at its rear and for following rotational movement. Mounted for sliding movement in channel 54 of nesting assembly support 51 is height adjusting slide 57. Slide 57 is fixedly attached to nesting mount 55 by a suitable screw 58. Tightening screw 58 biases nesting mount 55 against nesting slide support 62, in a firm grip. Nesting slide 57 and thus nesting mount 55 may be fixedly positioned at any desired height within channel 54 of the nesting slide support 62 by the loosening or tightening of screw 58 as necessary, thereby accepting any of a large range of sizes in containers for printing in the nesting assembly. Nesting frame 59 is fixedly secured in cantilever fashion on nesting mount 55.

As shown in FIG. 2, nesting frame 59 holds the object 90 to be printed, in conjunction with nose cone or chuck 60 in a secure and immovable manner. The nesting frame, of course should be changed to fit differently sized objects being printed, for a more secure and tenaceous grip on the object 90. One end of each of double guide rods 53 is secured in spaced parallel fashion in openings at the lower end of the nesting support block 51 by set screws 52.

Figure 3:
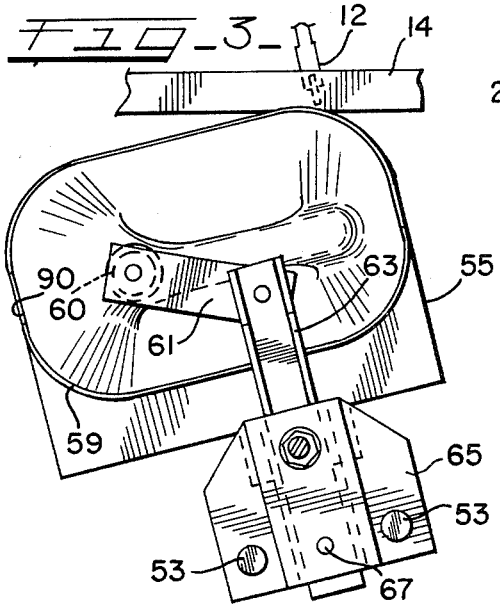
FIG. 3 is a front end view taken along the lines 3—3 of FIG. 2.

Similarly mounted at the opposite end of each of double guide rods 53 is a nose cone support 65 for reciprocal horizontal travel along the parallel guide rods 53. As shown in FIG. 3, a front slide bar 63 is mounted in an adjustable manner on the nose cone support 65, being securable at a desired height by set screw 67. A nose cone mounting arm 61 is pivotally secured and extends out from the upper end of the front slide 63. A nose cone or chuck 60 is attached to the outer end of the nose cone arm 61 facing the nesting support 59. By the adjustment of the height of the front slide bar 63 and the angle of the nose cone arm 61, the nose cone 60 may be positioned for insertion of the nose cone 60 into the opening of any size and shape container desired to be printed. Of course, a wide-mouth container will require an appropriately large chuck.

The front slide mount 65 and slide 63 may be reciprocated horizontally on parallel guide rods 53 by pneumatic actuator 93 which is supported by front assembly mount 72 on tooling post 91. By the depression of foot pedal controls or the like, shop air pressure may be applied to extend the front sliding block 65 toward the object to be printed for engagement of nose cone 60 into the opening of the object 90. The front sliding block can be retained in that position at a slight positive pressure for keeping the object 90 securely in place for printing. At the end of the printing step, the object may be moved by release of the forward pressure and application of reverse pressure. As such structure is well known in the art, being described in U.S. Pat. No. 3,139,824 to Derrickson, detailed description of this feature is not considered necessary to a description of the subject invention. In addition, air pressure may be utilized to provide a positive air pressure within a plastic container and thus a rigid surface for printing. This feature is also well known in the art, and therefore will not be described further.

In the operation of the subject invention, the radius of curvature of the object 90 to be printed is first found through known methods and instruments. The arc adjusting bar 30 is visually lined up with the tee bar 38 in a vertical position to ascertain the center and level position of the entire assembly. The radius of curvature of the object 90 to be printed, found as described above, is then located on scale 28 of rear slide 30. Screws 33, 48, and 69 are loosened to allow vertical positioning of the entire assembly relative to assembly mounted or brackets 42 and 72, including double guide bars 39 and 53, as necessary to align the top surface of the rear sliding block 32 on the appropriate indicator mark 27 on the scale 28. When the correct position has been reached, and the entire nesting assembly 50, including guide rods 39 and 53, is horizontally level and parallel with tooling post 91, screws 33, 48, and 69 are tightened to retain the assembly in such a level position. Slide 57 is adjusted in height to bring the surface of the object to be printed into contact with screen and screw 58 is tightened, thereby locking the nesting assembly and object into position.

When the printer is actuated, the drive carriage 26 reciprocates on shaft 20 and the arc adjusting bar 30 follows this motion by virtue of the roller 36 in slot 34, traveling in an arc-like manner, having an axis of rotation centered on screw 33. By virtue of the double guide rods 39, rear mounting block 40 also rotates, imparting the rotational movement to shaft 41, which, in turn, rocks nesting frame 59 and nesting mount block 55, to thereby rock the surface of the work piece 90 in a timed relationship to match the linear speed of the object 90 with that screen.

Upon consideration of the foregoing, it will become obvious to those skilled in art that various modifications may be made without departing from the invention embodied herein. Therefore, only such limitations should be imposed as are indicated by the spirit and scope of the appended claims.

I claim:

1. A printing machine for use in printing on the curved surfaces of three-dimensional objects, including a drive carriage for driving a screen in horizontal reciprocal motion at a given linear speed, a stationary squeegee for forcing ink through the screen onto the object to be printed, a tooling post and an object holding assembly mounted on said tooling post for holding and presenting the peripheral surface of said object for printing at the same linear speed as the screen, said object holding assembly comprising a nesting means for supporting said object, a drive tee securely attached to said drive carriage, said drive tee having a vertical channel means therein, a following means comprising a slide means having an end captivated in said channel means for rotational and vertical travel, a first slide mount attached to said slide means for selective vertical placement thereon, a drive block spaced from and attached to said slide mount for following parallel movement, a first bracket mounted on said tooling post, a drive shaft journalled in said first bracket in a midsection portion, said drive shaft being fixedly mounted to said drive block at a rear end and to said nesting means at the front end, and transferring the motion of said drive block to said nesting means for rocking said object to present a peripheral surface of said object for printing at a desired linear speed.

2. The printing machine of claim 1 wherein said arc is adjustable in size by the selective vertical placement of said object holding means relative to said first bracket and said drive carriage for rocking said object to present a peripheral surface of said object for printing at the same linear speed as said screen.

3. The printing machine of claim 1 wherein said rear portion of said following means is adjustable in height relative to said drive carriage to fix the size of the arc in which said rear portion swings and thereby rock said object nesting means to present the linear surface of said object to the screen at a desired linear speed.

4. An accessory for use with printing machines for the curved surfaces of three-dimensional objects;

said printing machine including a drive carriage for driving a screen in horizontal reciprocal motion at a given linear speed, a stationary squeegee for forcing ink through the screen onto the object to be printed, a tooling post, first and second brackets on said tooling post;

said accessory including a nesting means supported on said first and second brackets for securing said object and rotating said object to present the peripheral surface of said object for printing at the same linear speed as the screen;

a channel means extending perpendicularly from said drive carriage;

following means extending from said channel means to said first bracket, said following means including a slide means captivated at one end in said channel means for movement therein, the motion of said drive carriage causing said captivated end of said slide means to oscillate;

a slide block vertically adjustably secured to said slide means for vertical movement thereon, a drive block secured for parallel movement to said slide block, said first bracket having a longitudinal slot, said drive block mounted to said first bracket in said slot, the position of said drive block being vertically adjustable within said slot to a desired height with a drive block locking means retaining said drive block at said position, said nesting means being secured to said drive block for following movement for swinging in an arc in response to the movement of said drive block to present a surface of said object to the screen at a desired linear speed.

5. The accessory of claim 4 whereby said slide means includes a roller at an upper end, said roller being captivated in said channel means of said drive tee and allowing free rotational movement of said slide means about a central roller axis and free vertical movement within said channel means.

6. The accessory of claim 4 whereby said slide block is movable along said slide means to a desired height, said slide block having a locking means for locking said slide block at said desired height.

7. A printing machine for use in printing on the curved surfaces of three-dimensional objects, including a drive carriage for driving a screen in horizontal reciprocal motion at a given linear speed, a stationary squeegee for forcing ink through the screen onto the object to be printed, a tooling post, support means on said tooling post, and an object holding assembly mounted to said support means for holding and rotating said object to present the peripheral surface of said object for printing at the same linear speed as the screen, said object holding assembly including a channel means extending vertically from said drive carriage, following means having a front portion journalled in said support means on said tooling post and a rear portion captivated by said channel means for free vertical and rotational movement, the horizontal movement of said drive carriage causing corresponding movement of said rear portion in an arc, a nesting means for holding said object secured to said front portion of said following means for rotational movement therewith and supported by said support means, said following means and said nesting means thereby being rotated in response to the movement of said drive carriage, thereby presenting a surface of said object to the screen at said desired linear speed.

* * * * *